United States Patent [19]

Golub

[11] 4,412,116

[45] Oct. 25, 1983

[54] CIRCUIT BREAKER WITH UNITARY ACTUATING SHAFT

[75] Inventor: Gregory J. Golub, Athens, Ga.

[73] Assignee: Westinghouse Electric Corp., Pittsburgh, Pa.

[21] Appl. No.: 382,251

[22] Filed: May 26, 1982

[51] Int. Cl.[3] ..... H01H 19/52; H01H 77/08

[52] U.S. Cl. ..... 200/155 R; 335/16; 200/260; 200/307; 200/303

[58] Field of Search ..... 200/63 R, 63 A, 155 R, 200/259, 260, 261, 293, 303, 307, 336, 11 R, 11 B; 335/16, 195

[56] References Cited

U.S. PATENT DOCUMENTS

| | | | |
|---|---|---|---|
| 1,379,819 | 5/1921 | Hjorth | 200/63 R |
| 1,785,194 | 12/1930 | Hammerly . | |
| 2,466,072 | 4/1949 | Batcheller | 200/155 R |
| 3,167,620 | 1/1965 | Keyser et al. | 200/155 R |
| 3,419,828 | 12/1968 | Bremer | 335/16 |
| 3,461,259 | 8/1969 | Leonard et al. | 200/63 A |
| 3,538,287 | 11/1970 | Mrenna . | |
| 3,590,183 | 5/1971 | Leonard | 200/67 B |
| 3,609,267 | 9/1971 | Lenina et al. | 200/155 R |
| 3,632,935 | 1/1972 | Stegmaier | 200/155 R |
| 3,715,543 | 2/1973 | Keto et al. | 200/155 R X |
| 3,800,106 | 3/1974 | Simmons . | |
| 3,887,888 | 6/1975 | Bayles et al. | 335/16 X |

FOREIGN PATENT DOCUMENTS

| | | | |
|---|---|---|---|
| 59819 | 1/1968 | Denmark | 200/155 R |
| 7429 | 2/1982 | European Pat. Off. | 200/307 |
| 2718346 | 11/1977 | Fed. Rep. of Germany | 200/250 |

*Primary Examiner*—Stephen Marcus
*Assistant Examiner*—Ernest G. Cusick
*Attorney, Agent, or Firm*—L. P. Johns

[57] ABSTRACT

A circuit breaker with unitary actuating shaft characterized by a dielectric housing having separable housing sections for mounting opposed stationary contacts; a unitary, hollow actuating shaft for mounting movable contacts between open and closed positions with the opposed stationary contacts; and each section having an end wall with an aperture through which the shaft extends and is retained in alignment.

6 Claims, 13 Drawing Figures

FIG. 2
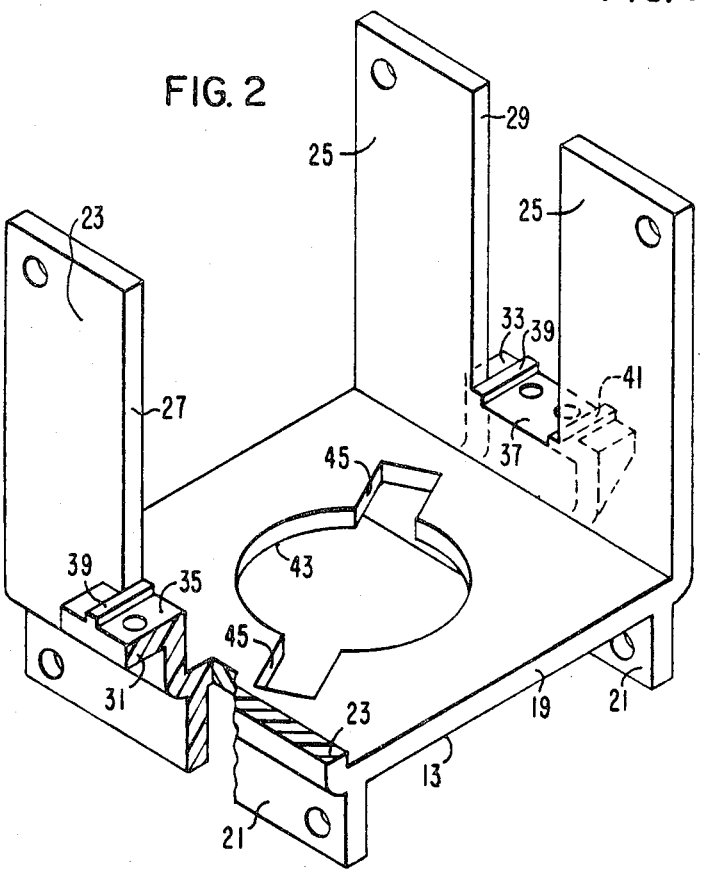
FIG. 3
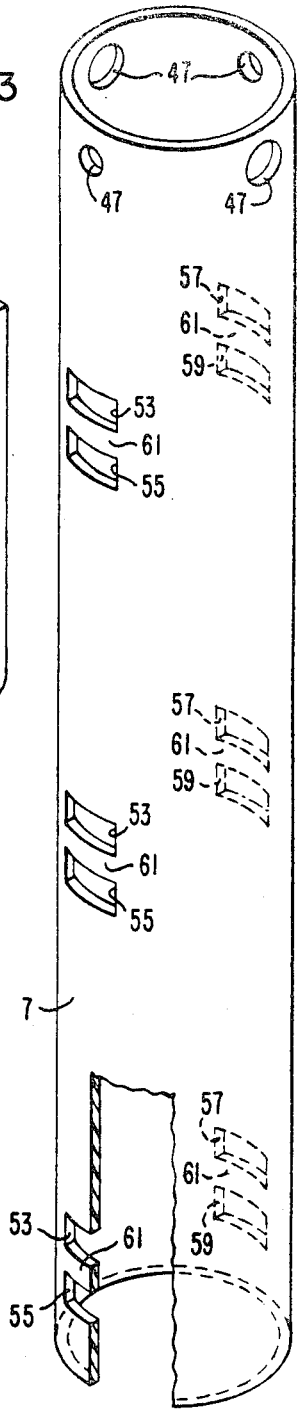
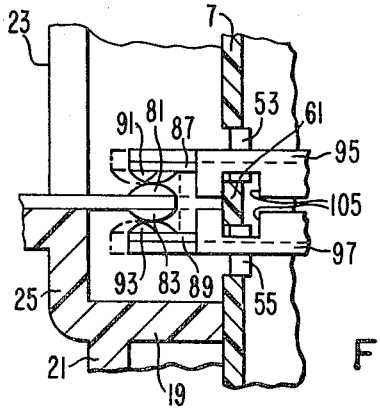
FIG. 4A

FIG. 9
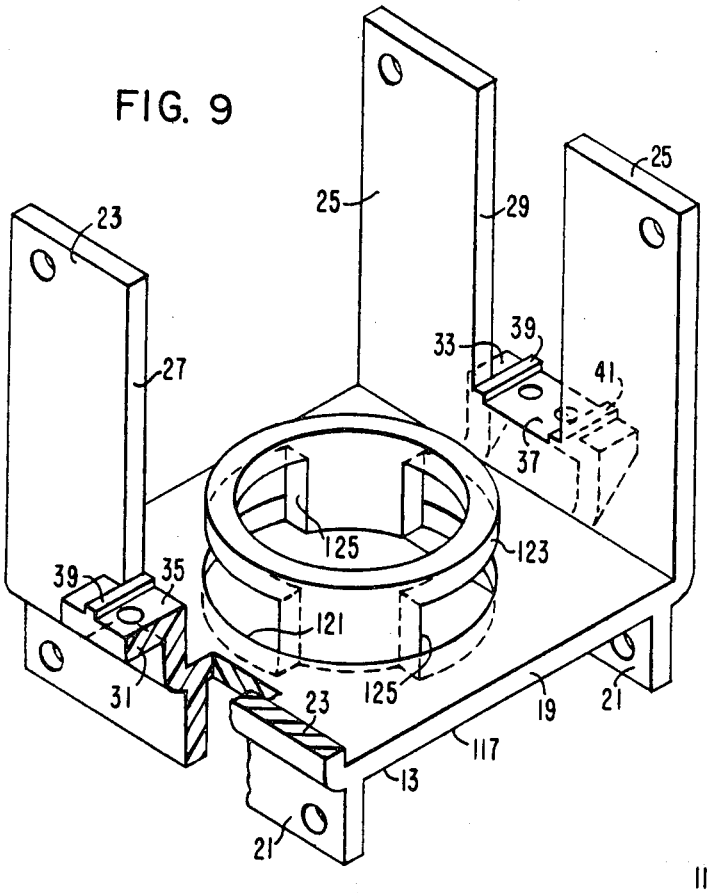
FIG. 10
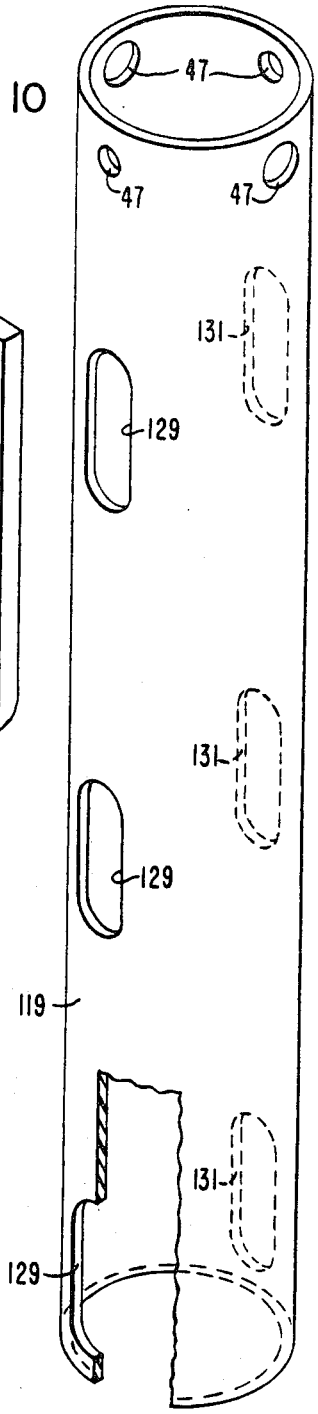
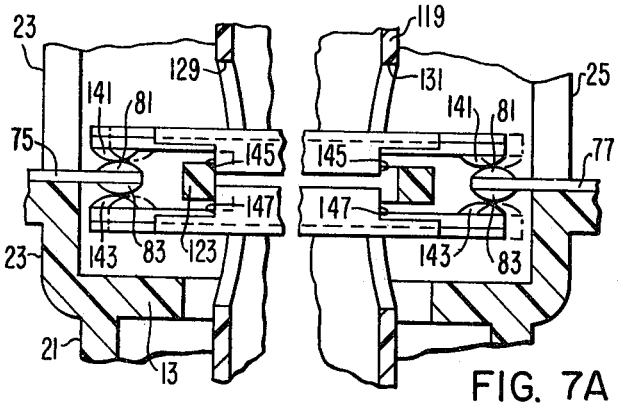
FIG. 7A

CIRCUIT BREAKER WITH UNITARY ACTUATING SHAFT

CROSS-REFERENCE TO RELATED APPLICATION

This application is related to the copending application of Gregory J. Golub, Ser. No. 417,964, filed Sept. 14, 1982.

BACKGROUND OF THE INVENTION

1. Field of the Invention:

This invention relates to a circuit breaker having a unitary actuating shaft for moving movable contacts in alignment with stationary contacts.

2. Description of the Prior Art:

The so-called "quick-make and quick-break" type of switch is particularly suitable for distribution transformers where the switch contacts are immersed in transformer oil. Such switches are disclosed in U.S. Pat. Nos. 3,461,259 and 3,590,183 and are provided with an overcenter spring mechanism for rotatably moving contact structures for opening and closing circuits. The rotatable moving contact structure comprised a rotatable contact carriage carrying pairs of contact fingers extending outwardly from the rotatable carriage, and making separable engagement with corresponding stationary spaced blade-shaped contacts.

Inasmuch as each opening and closing of the contacts causes vibration of the structure, it sometimes happens that mechanical joints between the several parts including the spring mechanism, the rotatable moving contact structure, and the contacts perse, gradually loosen and develop so-called "slop" in the joints to such an extent that the switch may not open as required.

Associated with the foregoing has been a problem of assembly tolerances. Usually such switches are provided as single or three-phase switches, as required, by the use of housing decks which are detachably added in accordance with the prescribed number of phases. As a result there has been an assembly problem of getting the movable and stationary contacts properly aligned within tolerable limits.

SUMMARY OF THE INVENTION

It has been found in accordance with this invention that the foregoing problems may be satisfied by providing a circuit breaker comprising a dielectric housing including at least one housing section having side walls and an end wall, spaced stationary contact structures for each housing section extending through the side walls and into the housing interior, a dielectric, hollow actuating shaft within the housing with one end of the shaft being journally-mounted in an opening in the end wall and the shaft being rotatable between open and closed circuit positions, a movable contact structure for each housing section mounted on the shaft and having end portions engaged with the stationary contact structures when the shaft is in the closed circuit position, and rotatable driving means for turning the shaft between the open and closed circuit positions.

The advantage of the device of this invention is that it facilitates contact alignment between rotating contacts and stationary contacts and thereby improves manufacturability and reduce cost of the switch. Moreover, the switch includes the advantage of utilizing electromagnetism to maintain contact pressure during momentary surges of current and eliminating contact galling.

BRIEF DESCRIPTION OF THE DRAWINGS

FIG. 2 is a perspective view, with a portion broken away, of a deck;

FIG. 3 is a perspective view of a tubular shaft;

FIG. 4A is a fragmentary view of a portion of FIG. 4 showing the interaction of notches with the shaft;

FIG. 7A is a fragmentary view of a portion of FIG. 7 showing the interaction of notches with the shaft;

FIG. 9 is a perspective view of the deck of the embodiment shown in FIG. 6;

FIG. 10 is a tubular shaft of the embodiment of FIG. 6; and

DETAILED DESCRIPTION OF THE PREFERRED EMBODIMENTS

Figure 1:
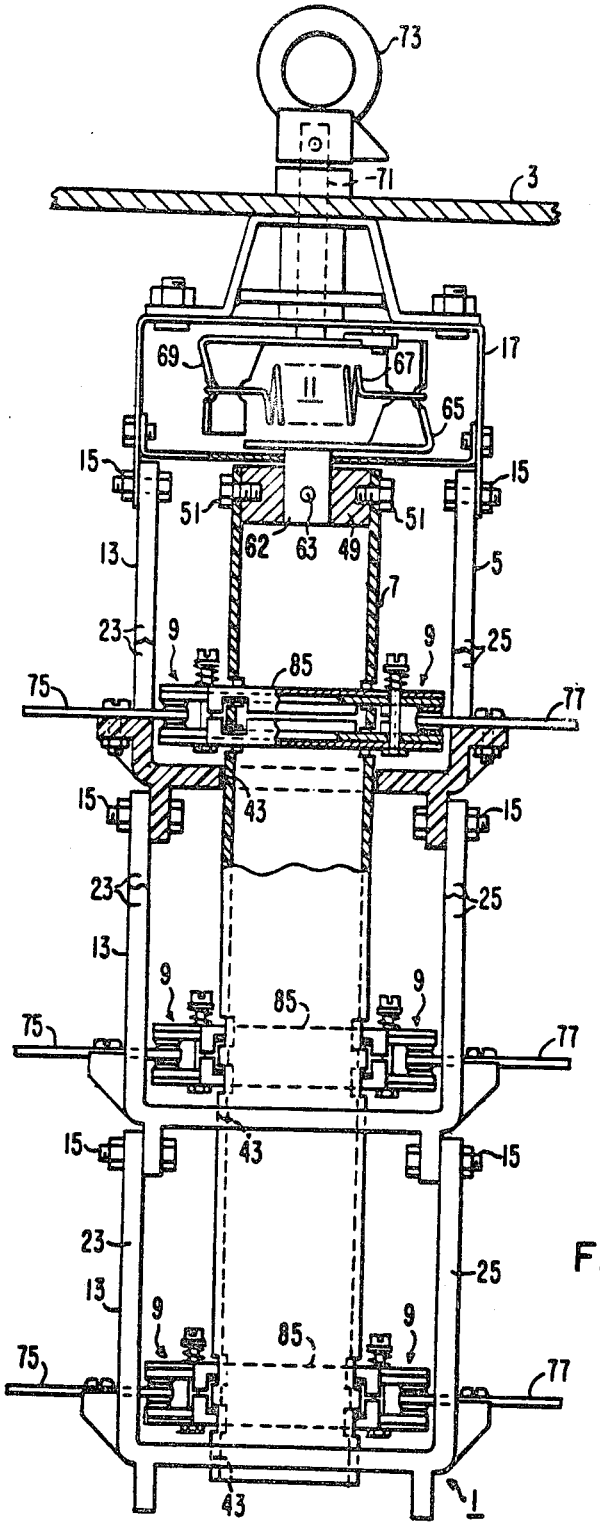
FIG. 1 is an elevational view partly in section of a circuit breaker of this invention.

In FIG. 1, a circuit breaker or switch is generally indicated at 1 and is typically used in conjunction with a pad mounted or submersible-type transformer which provides underground distribution circuits for residential neighborhoods. Generally, a submersible type transformer is disclosed in U.S. Pat. No. 4,361,259, issued Aug. 12, 1969 to M. G. Leonard et al., which comprises an underground vault in which a distribution transformer is located within a cylindrical housing. The transformer comprises a high-voltage winding and a low-voltage secondary winding which are inductively coupled. To provide a desired switching operation internally of the transformer tank, the switch 1 is mounted on an upper cover 3 of the transformer tank and it comprises an outer housing 5, a tubular shaft 7, a plurality of vertically spaced pairs of contacts generally indicated at 9, and an overcenter spring mechanism 11.

Although the switch 1 is adapted for use with one or more phases, a three phase switch is disclosed for purposes of illustration. Accordingly, the housing 5 is comprised of three separable U-shaped supporting members or decks 13 of similar construction. Adjacent decks 13 are secured together by nut and bolt assemblies 15, and the uppermost deck is similarly secured to a box-like frame 17 in which the overcenter spring mechanism 11 is disposed. As shown in FIG. 2, each deck 13 is a U-shaped member comprised of an electrical dielectric material which is molded to include a base 19 having a pair of spaced mounting flanges 21, and a pair of oppositely disposed upright sides 23, 25. Each upright side 23, 25 include a slot 27, 29, respectively. An out-turned flange 31, 33 is provided at the lower end of the slots 27, 29, respectively. The flanges 31, 33 have top surfaces 35, 37, respectively, which are in planar alignment. Each flange 31, 33 likewise includes a pair of similar spaced ribs 39, 41. The base 19 has a hole 43 through which the shaft 7 extends. Each hole 43 includes a pair of oppositely extending hole portions 45 to facilitate assembly, namely, insertion of the shaft 7 with movable contacts mounted thereon.

The tubular shaft 7 (FIG. 3) is an elongated member comprised of dielectric material. At the upper end, similar bolt holes 47 are provided for mounting (FIG. 1) the upper end of the shaft 7 on an end plug 49 by bolts 51. At vertically spaced intervals, pairs of openings 53, 55 are disposed along one side of the shaft and in alignment with each other. Similar openings 57, 59 are disposed in diametrically opposite positions of the openings 53, 55, respectively. Each pair of openings 53, 55 and 57, 59 are separated by tube portions 61.

When assembled, the tubular shaft 7 (FIG. 1) is disposed centrally of the outer housing 5 and extends through the aligned holes 43 which retain the shaft in alignment with a shaft 62 which is rigidly secured in the plug 49 by a pin 63. The upper end of the shaft 62 is secured to a spring arm 65 of the over-center spring mechanism 11. A spring 67 extends between the arm 65 and a driving crank arm 69 which is secured to the lower end of an actuating shaft 71 which in turn is secured to an eyelet operating handle 73. Rotation of the handle 73 between two positions moves the spring 67 over-center of the shaft 63 in a conventional manner, thereby rotating the tubular shaft 7 between open and closed positions of the switch contacts in a quick-make and quick-break load-break manner to avoid welding of the movable and stationary contacts.

Figure 5:
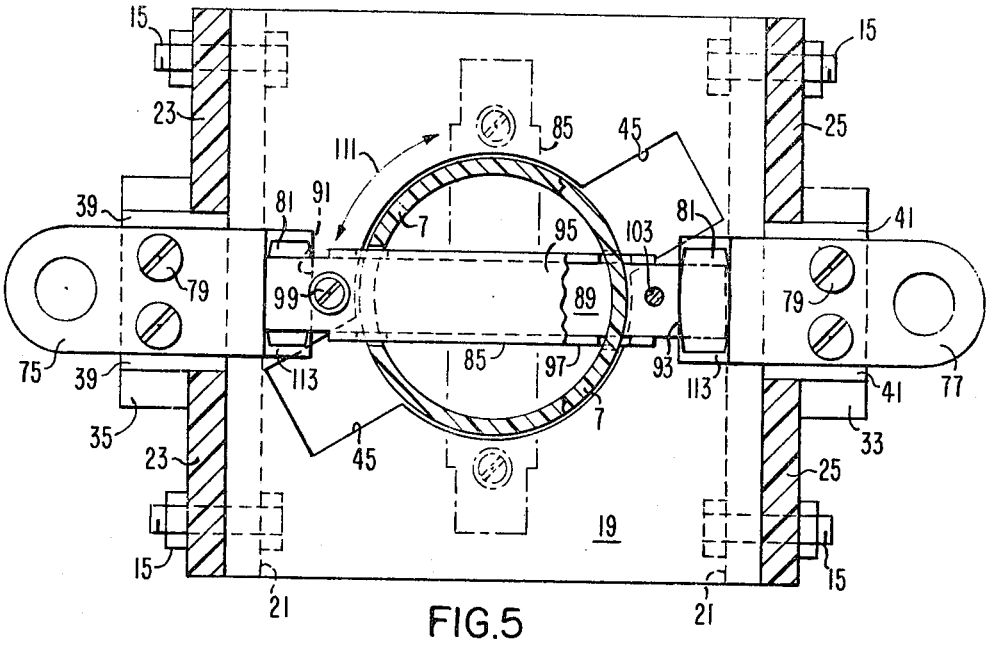
FIG. 5 is a horizontal sectional view taken on the line V—V of FIG. 4.
Figure 4:
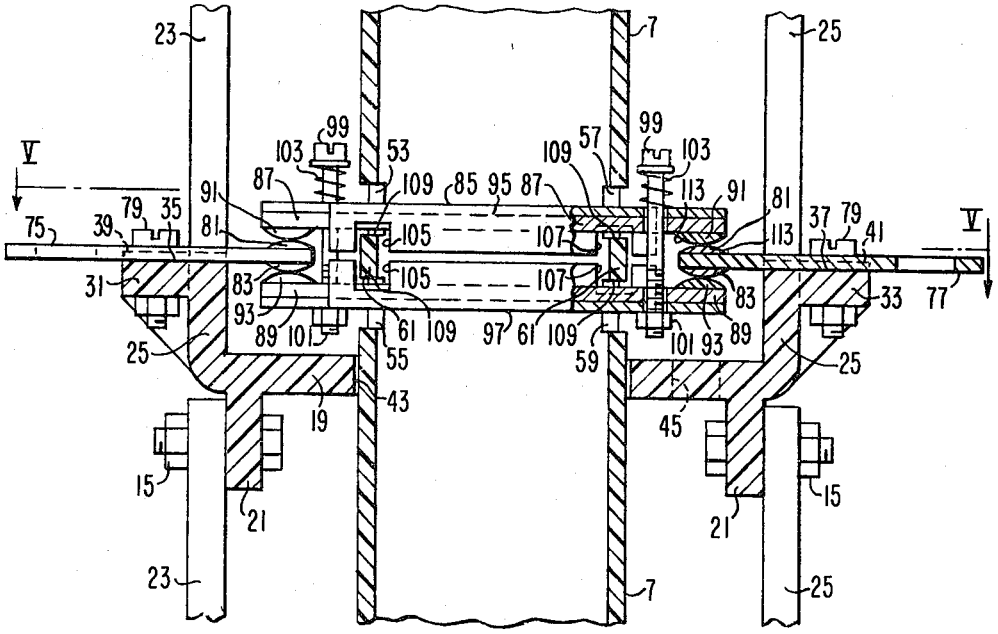
FIG. 4 is a fragmentary vertical sectional view showing one switch unit in the closed position.

As shown in FIGS. 4 and 5, the phase structure of any phase shown in FIG. 1 includes a pair of spaced stationary contact blades 75, 77. The blades 75, 77 are in planar alignment and mounted on aligned planes 35, 37 where they are fixedly positioned between ribs 39, 41, respectively, and secured in place by similar bolts 79. The inner end of each blade 75, 77 includes similar upper contacts 81 and lower contacts 83.

A rotatable contact carrier 85 is disposed between stationary contact blades 75, 77 for making and breaking the circuit therebetween. The carrier 85 comprises a pair of contact carrying bridges 87, 89 on which similar movable contacts 91, 93 are mounted for engagement with stationary contacts 81, 83 (FIG. 4). The contact carrier 85, likewise comprise a pair of channels 95, 97 of magnetizable, or ferromagnetic material. Each channel 95, 97 is a U-shaped member and includes a base and opposite flanges. The contact carrier 85 likewise comprises a pair of clamping devices 99 to provide sufficient contact pressure during normal operating conditions. Each clamping device 99 comprises a bolt and nut unit 101 as well as a spring 103.

The circuit path extends from the stationary contact blade 75 through stationary contacts 81, 83, the movable contacts 91, 93, the contact carrying bridges 87, 89, the movable contacts 91, 93, the stationary contacts 81, 83 to the stationary contact blade 77. Under normal operating conditions, the pressure applied by the clamping devices 99 is sufficient to maintain satisfactory electrical contact between the movable and stationary contacts. However, where a high current surges through the path of the circuit and electromagnetic flux is generated around the rotatable contact carriage 85 and is contained within the channels 95, 97, causing the U-shaped channels to be drawn together, thereby compressing the stationary contacts 91, 93 against the movable contacts 81, 83. In this manner, any damage to the contacts such as welding is avoided.

As shown in FIGS. 4 and 5, the rotatable contact carrier 85 extends through the tubular shaft 7 with the upper portion including the parts 87, 95 extending through the upper openings 53, 57 and with the lower parts 89, 97 extending through the lower openings 55, 59 leaving the shaft portions 61 disposed between said openings as set forth above. The notches 105, 107 straddle the shaft portion 61, thereby preventing the rotatable contact carrier 85 from moving longitudinally beyond a tolerable limit which would minimize surface-to-surface engagement between the several contacts as shown in FIG. 4A.

Moreover, there are gaps 109 between the contact carrier bridges 87, 89 and the shaft portions 61 when the contacts are in the closed position (FIG. 4) to allow the springs 103 to exert full pressure between the several contacts. When, however, the rotatable contact carrier 85 is moved (FIG. 5) through a direction as indicated by an arrow 111 to an open position, the springs 103 close the bridges 87, 89 to their closest points of contact, or against the surfaces of the shaft portion 61.

In addition to the foregoing, the stationary and movable contacts 81, 91, 93 are contoured, such as arcuate, as shown at 113 to facilitate closing of the contacts.

With regard to the embodiment of the invention shown in FIGS. 1–5, it is noted that one unit shaft 7 is used to simultaneously open or close all three decks of the three phase circuit. Moreover, the shaft portions 61 at each deck level are aligned with the corresponding pair of contact blades 75, 77 that contact misalignment is substantially eliminated.

Figure 6:
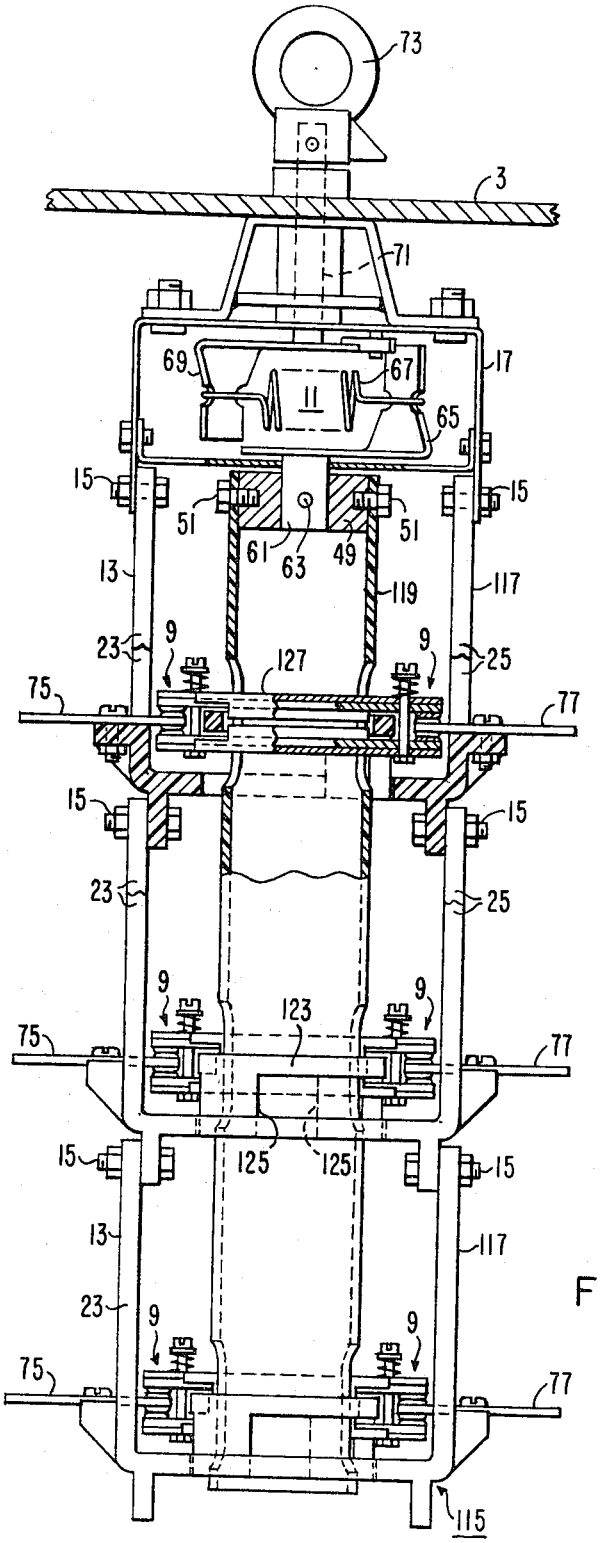
FIG. 6 is an elevational view of another embodiment of the switch.

Another embodiment of the invention is shown in FIGS. 6–11 in which similar numerals refer to similar parts throughout the drawings. In FIG. 6, a circuit breaker or switch is generally indicated at 115 and comprises a number of outer housing units 117 and a tubular shaft 119. The housing units 117 and the tubular shaft 119 substantially correspond to the outer housing units 5 and tubular shaft 7 except as described hereinbelow.

As shown in FIG. 9, the outer housing unit 117 comprises a central hole 121 and an alignment ring 123. The ring is supported on the pair of spacers 125 which extend upwardly from the base 19 of the unit 117. The spacers 125 are so positioned that (FIG. 8) they are out of alignment with the positions of movement of a rotatable contact carrier 127. The alignment ring 123 is in planar alignment with the stationary contact blades 75, 77. Planar alignment.

The tubular shaft 119 resembles the tubular shaft 7 except that the former includes vertically elongated openings 129, 131 at each deck level, whereby the tube 119 is devoid of a horizontal shaft portion similar to the shaft portion 61 of the shaft 7.

Figure 11:
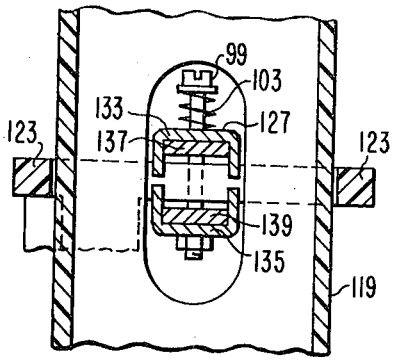
FIG. 11 is a vertical sectional view taken on the line XI—XI of FIG. 7.
Figure 7:
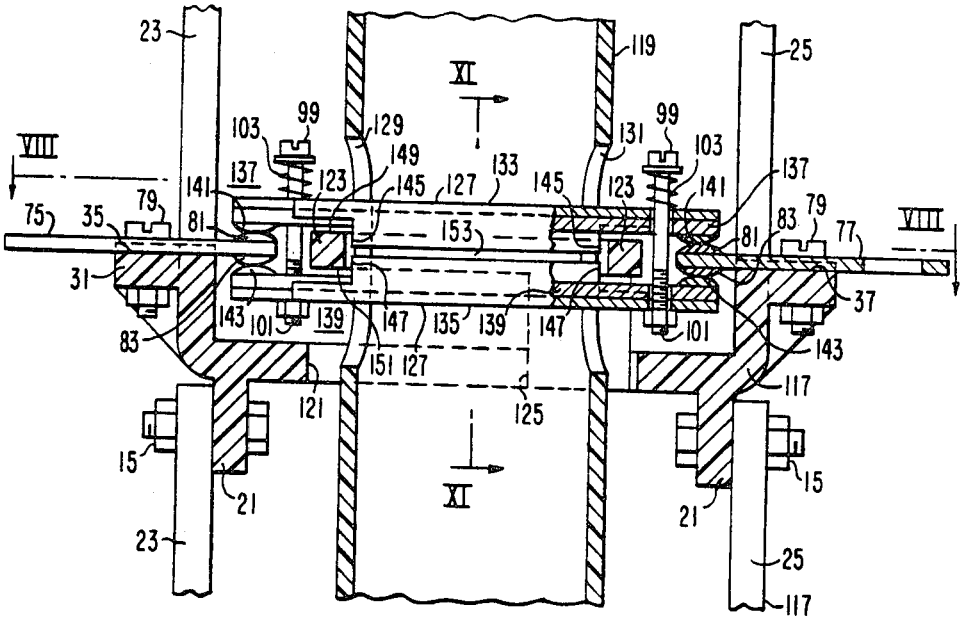
FIG. 7 is a fragmentary vertical sectional view showing one unit of the switch in the closed position.

In FIG. 7, the rotatable contact carrier 127 extends through the openings 129, 131 and comprises channels 133, 135, contact carrying bridges 137, 139, and movable contacts 141, 143. Like the channels 95, 97 (FIG. 4), the channels 133, 135 are comprised of magnetizable material such as A1S1 1010 cold rolled steel. The bridges 137, 139 are comprised of a metal, such as copper, and are disposed between the corresponding flanges of the channels 133, 135 (FIG. 11). To prevent the assembly of the rotatable contact carrier 127 from moving longitudinally with respect to the stationary contacts 81, 83, the channels 133, 135 are notched to provide shoulders 145, 147 which limit such movement by a clearance space between the shoulders and the inner surface of the alignment ring 123 as shown in FIG. 7A.

When the circuit is in the closed condition (FIG. 7), the clamping devices 99 hold the contacts 141, 143 in tight electrical engagement with the stationary contacts 81, 83 and gaps 149, 151 exist between the alignment ring 123 and the bridges 137, 139 on opposite sides thereof. Similarly, a gap 153 exists between opposed edges of the flanges of the channels 133, 135. However, when the rotatable contact carrier is in the position 127*a* (FIG. 8), the clamping device compresses the assemblies of the upper and lower contact carrying bridges 137, 139 into engagement with the alignment ring 123 which is the position of the bridges assembly for planar alignment with stationary contact blades 75, 77 and the corresponding upper and lower contacts 81, 83.

Figure 8:
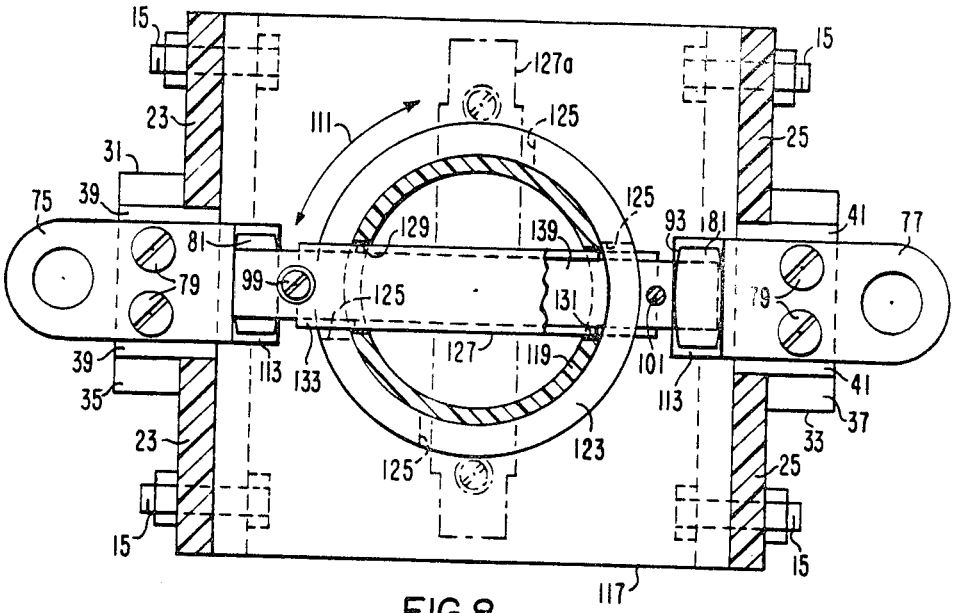
FIG. 8 is a horizontal sectional view taken on the line VIII—VIII of FIG. 7.

Thus, inasmuch as the alignment ring 123 and the corresponding spacers 125 are integral molded parts of the outer housing unit 117 and are therefore molded into exact planar alignment with the surfaces 35, 37. When, therefore, the shaft 119 (FIG. 6) is assembled in place between the several alignment rings 123 and secured to the plug 49 by the bolts 51, the rotatable contact carrier 127 is disposed in the position 127*a* (FIG. 8). Accordingly, the alignment ring 123 automatically aligns the contacts 141, 143 with the contacts 81, 83.

In addition, it is pointed out that the spacers 125 are disposed (FIG. 8) at diametrically opposite positions to enable movement of the rotatable contact carrier clockwise and counterclockwise between the open and closed circuit positions.

In conclusion, the device of this invention avoids the disadvantages of prior structures because the tubular shaft holds the contacts in place without riveted or pinned joints. Moreover, it is shown in FIG. 11 an electromagnetic force within the channels 133, 135 holds the movable contacts into tighter engagement with the stationary contacts during high current surges. At regular currents of from about 200 to 300 amperes, the electromagnetic force are negligible, but at high surges of 10,000 amperes, the force provides the required contact pressure to prevent welding of the contacts. Finally, by avoiding riveted or bolted joints, a more reliable switch is provided.

What is claimed is:

1. An electric switch comprising:

a dielectric housing including at least one housing section having side walls and an end wall;

spaced stationary contact structures for each housing section extending through the side walls and into the housing interior;

a dielectric, hollow actuating shaft within the housing with one end of the shaft being journally-mounted in an opening in the end wall and the shaft being rotatable between open and closed circuit positions;

a movable contact structure for each housing section mounted within the shaft and including a pair of parallel conductors having end portions clampingly engaging corresponding stationary contact structures when the shaft is in the closed circuit position;

rotatable driving means for turning the shaft between the open and closed circuit positions;

the shaft having aperture means, and the conductor extending through the aperture means; and each parallel conductor being mounted within a channel comprising a base and opposite flanges, each flange having notch means for contact with the shaft for preventing longitudinal shifting of the conductor.

2. The switch of claim 1 in which the channels face each other with corresponding flanges extending toward and spaced from each other, and the channels being spaced from each other and being comprised of a ferro-magnetic material, whereby an adductive electromagnetic force occurs between the spaced channels in response to a high surge of current thereby holding the conductors tightly against the stationary contact structures.

3. The switch of claim 2 in which each pair of assembled conductors and channels are biased together to effect greater pressure on the stationary contact structures when in the closed circuit position.

4. The switch of claim 1 in which each housing section comprises first mounting means for supporting each spaced stationary contact structure on each side wall, second mounting means for supporting the movable contact structure, so that the stationary and movable contact structures are bolstered in proper alignment during assembly and operation of the switch.

5. The switch of claim 4 in which the first and second mounting means are spaced from the end wall, and the second mounting means surrounds the actuating shaft.

6. The switch of claim 5 in which each housing section comprises connecting means for adjustably securing adjoining sections together within limited slidable tolerances, the actuating shaft being unitary with the aperture means for each section being spaced along the shaft by distances corresponding to adjustable distances between the mounting means.

* * * * *